US006052092A

United States Patent [19]

Davis et al.

[11] Patent Number: 6,052,092

[45] **Date of Patent: *Apr. 18, 2000**

[54] WIRELESS TELECOMMUNICATION ANTENNA MOUNT

[75] Inventors: Murray W. Davis, Grosse Pointe Woods; Bruce F. Conrad, Clawson; Carl M. Fucinari, Troy, all of Mich.

[73] Assignee: The Detroit Edison Company, Detroit, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/005,812

[22] Filed: Jan. 12, 1998

[51] Int. Cl.[7] ..... H01Q 1/18

[52] U.S. Cl. ..... 343/757; 343/874; 343/890

[58] Field of Search ..... 343/757, 874, 343/878, 890, 892, 891; 52/651.02, 40, 223.4

[56] References Cited

U.S. PATENT DOCUMENTS

| | | | |
|---|---|---|---|
| 1,057,216 | 3/1913 | Bowman et al. | 52/40 |
| 1,685,663 | 9/1928 | Austin | 343/882 |
| 2,184,940 | 12/1939 | Cork et al. | 250/33 |
| 2,237,936 | 4/1941 | Jackson | 343/892 |
| 2,248,335 | 7/1941 | Burkhart | 250/11 |
| 2,479,962 | 8/1949 | Paulson | 52/651.02 |
| 2,583,747 | 1/1952 | Potter | 250/33 |
| 3,208,061 | 9/1965 | Gervasi et al. | 340/224 |
| 3,555,552 | 1/1971 | Alford | 343/726 |
| 4,596,989 | 6/1986 | Smith et al. | 343/709 |
| 4,698,640 | 10/1987 | Redman | 343/882 |
| 4,813,639 | 3/1989 | Midkiff et al. | 248/68.1 |

OTHER PUBLICATIONS

FWT Leading the Way P.O. Box 8597, Fort Worth Texas 76124–0597 "Power Mount" Brochure dated Dec. 1995.

*Primary Examiner*—Don Wong
*Assistant Examiner*—James Clinger
*Attorney, Agent, or Firm*—Reising, Ethington, Barnes, Kisselle, Learman & McCulloch, PC

[57] ABSTRACT

A wireless telecommunication antenna mount has a platform which carries a plurality of antennas. The platform is mounted on a pedestal in an angularly adjusted position. The pedestal is mounted on the top of an electric power transmission tower in a position above the tower.

7 Claims, 7 Drawing Sheets

WIRELESS TELECOMMUNICATION ANTENNA MOUNT

FIELD OF INVENTION

This invention relates generally to wireless telecommunication antenna mounts and more particularly to, but not restricted to, cellular phone, personal communication services (PCS), microwave, etc., antenna mounts installed on the top of an electric power transmission tower.

BACKGROUND AND SUMMARY

With the rapidly expanding use of wireless telecommunications, there is a growing demand for new antenna sites. Each new antenna site has usually required the installation of a separate antenna tower. However, there is growing opposition from communities to the proliferation of these towers because these communication towers and antennas are visually polluting the landscape. Often it is very difficult (or even impossible) to obtain approvals from zoning boards, planning commissions and environmentalists to erect new antenna towers. Furthermore, the time to obtain permits (if feasible) and the time and cost to design foundations and construct these communication towers are excessive.

To satisfy this demand for antenna sites without adding more and more towers, it has been discovered that existing electric power transmission towers make ideal sites for the installation of wireless telecommunication antennae. Others have implemented modifications to existing electric power transmission towers which either involve (a) the installation of a foundation in the center and at the base of the tower to support a steel pole which is inserted inside the existing tower and the antenna array is mounted on top of this pole, or (b) mounting standoff brackets on the side of each leg of the tower, which are used to support the antenna array.

Both of these methods have shortcomings. The first method, "steel pole inserted inside an existing tower design" usually requires soil testing, and designing and pouring a concrete foundation which is used to support the vertical load of the pole and the antenna. The curing time for the concrete foundation could be 2 to 3 weeks and a few days are needed to erect the steel pole and structurally tie it to the existing tower which provides the lateral support for the steel pole and its antenna. The shortcoming of this design is not only its high cost and the excessive time it takes to design and construct, but it also requires a modification to the electric power transmission towers which have a single lightning shield wire at the top center of the tower. The steel pole which is inserted within the electric power transmission tower cannot be installed without interfering with this shield wire. Therefore, this design requires structural modification of the steel members at the tower top.

The second method of using "standoff brackets" to support the antenna does not require a foundation. However, if the antenna array is mounted on the tower legs between the electric power conductors it cannot be rotated to optimize the communication efficiency, because to do so reduces the electrical clearances between the antenna and the electric power conductors. Also, if the antenna is mounted below the electric power phase conductors on the tower this method reduces the effective height and thus the usefulness of the antenna communication system.

To overcome the shortcomings of the above designs, the inventors have developed a wireless telecommunication antenna mount which has the following advantages over the current state-of-the-art:

1. No foundation is required which reduces the cost of the antenna tower;
2. No additional antenna tower or steel pole is needed to support the antenna array, which reduces the cost to install the antenna;
3. The antenna mount design can be installed on any electric power transmission tower and does not interfere with the existing single or double shield wire tower designs (and does not require removing and re-attaching shield wires), because it is installed above the shield wire(s);
4. The design contains a method that allows the antenna array to be rotated and aligned to improve communication efficiency without reducing electrical clearances;
5. Because the design does not require a new site, the time consuming process to obtain the necessary permits for an antenna is substantially reduced;
6. The design includes a unique hanger bracket, which is used to support the antenna coax cables from the antennas to the ground based equipment. These brackets are installed on the existing tower legs without field drilling the tower legs to attach same;
7. The antenna mount could be installed with a helicopter and attached to the electric power transmission tower without detaching the shield wires or de-energizing the entire transmission line. The latter feature is of significant benefit, especially where antenna mounts are installed on electric power transmission towers in remote areas or in mountainous terrains where foundations would be impractical to construct and or where it would be difficult to obtain a line shut-down to install the antenna mount;
8. The weight of this antenna mount is significantly less than the "steel pole inserted inside an existing tower" design, and the weight is independent of the height of the electric power transmission tower; and
9. The height of the antenna can be increased above the height of the tower by just extending the length of the antenna mounting members.

In accordance with this invention, a wireless telecommunication antenna mount is supported by the upper portion of an electric power transmission tower in a position above the tower and thus readily enables use with single and double shield wire tower designs. The antenna mount comprises a platform adapted to carry a plurality of antennas. The platform is mounted on a pedestal, and the pedestal in turn is mounted on the transmission tower.

Preferably, the antenna platform is adjustably mounted on the pedestal so that it may be angularly adjusted as desired. In the preferred embodiment about to be described, the means for angularly adjusting the platform comprises two circular plates which may be relatively rotated to the desired angular position and then secured together. This rotation or angular positioning can be accomplished either manually, or remotely by using a mechanized system to rotate the platform without interfering with the energized electric power transmission line.

One object of this invention is to provide a wireless telecommunication antenna mount having the foregoing features and capabilities.

Another object is to provide a wireless telecommunication antenna mount which is constructed of a relatively few simple parts, is rugged and durable in use, and is capable of being easily and inexpensively manufactured, assembled and adjusted.

These and other objects, features and advantages will become more apparent as the following description proceeds, especially when considered with the accompanying drawings.

DETAILED DESCRIPTION

Figure 1:
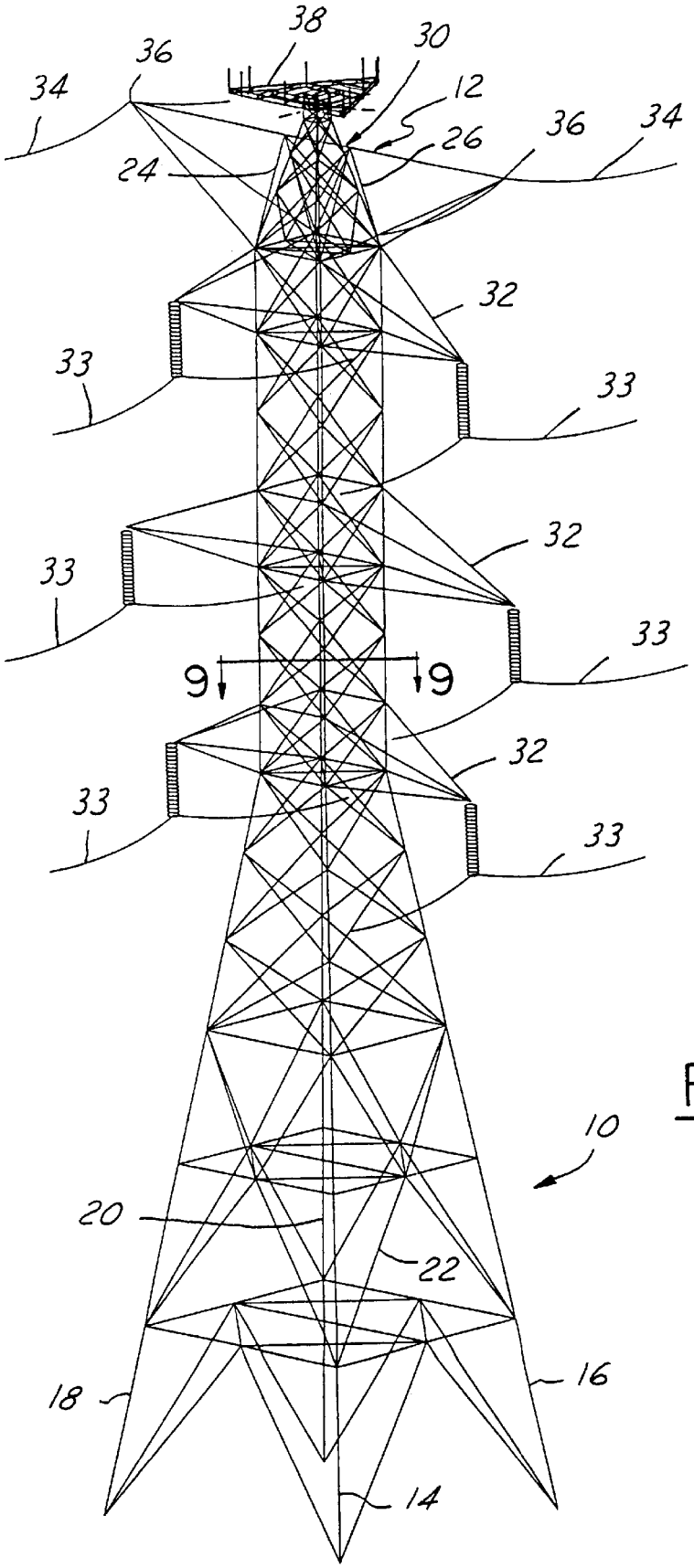
FIG. 1 is an isometric view of an electric power transmission tower and antenna mount showing a double shield wire design. The single shield wire design would consist of one shield wire attached at the top and center of the tower.
Figure 2:
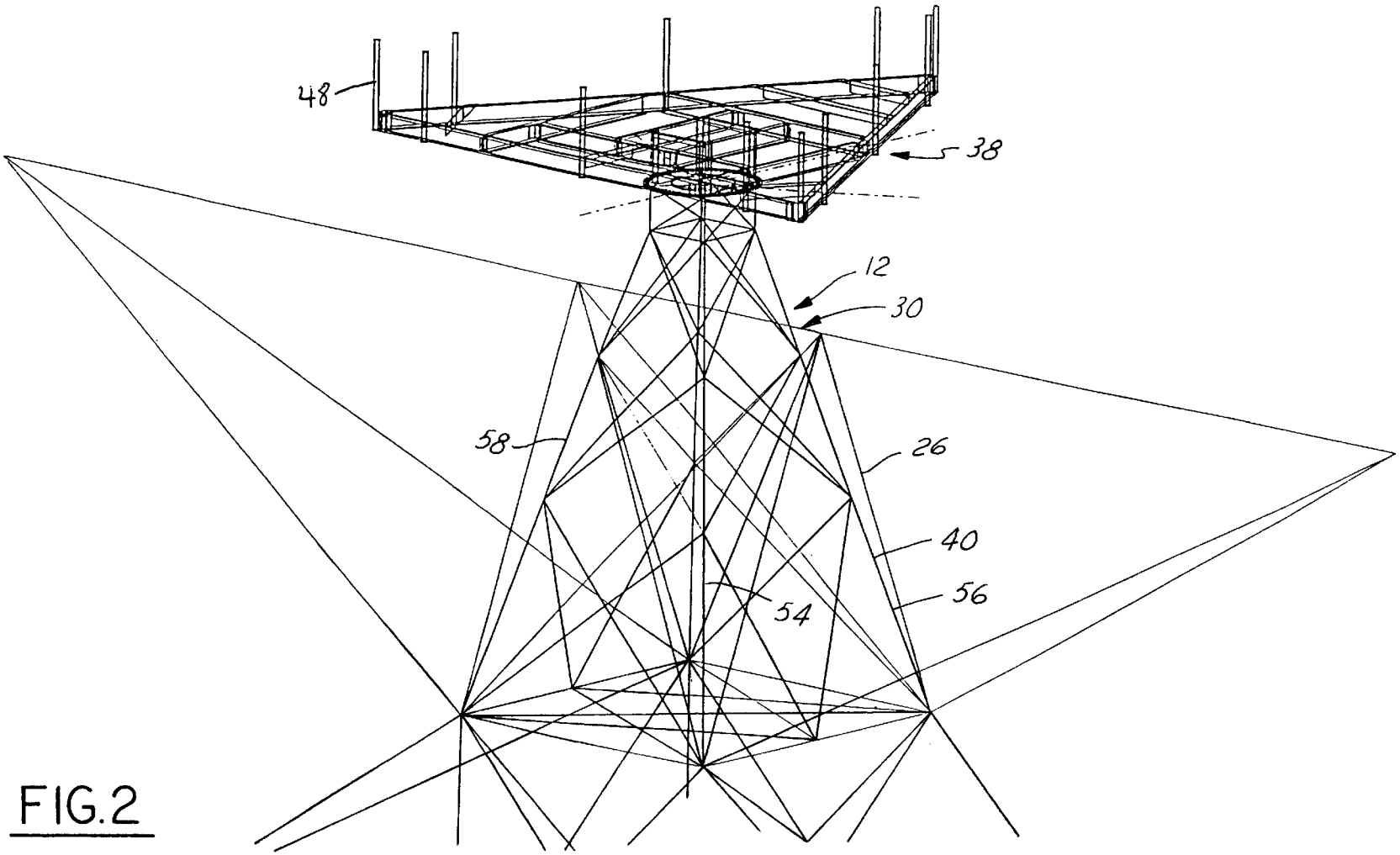
FIG. 2 is an enlarged isometric view of the top portion of the electric power transmission tower and antenna mount.
Figure 3:
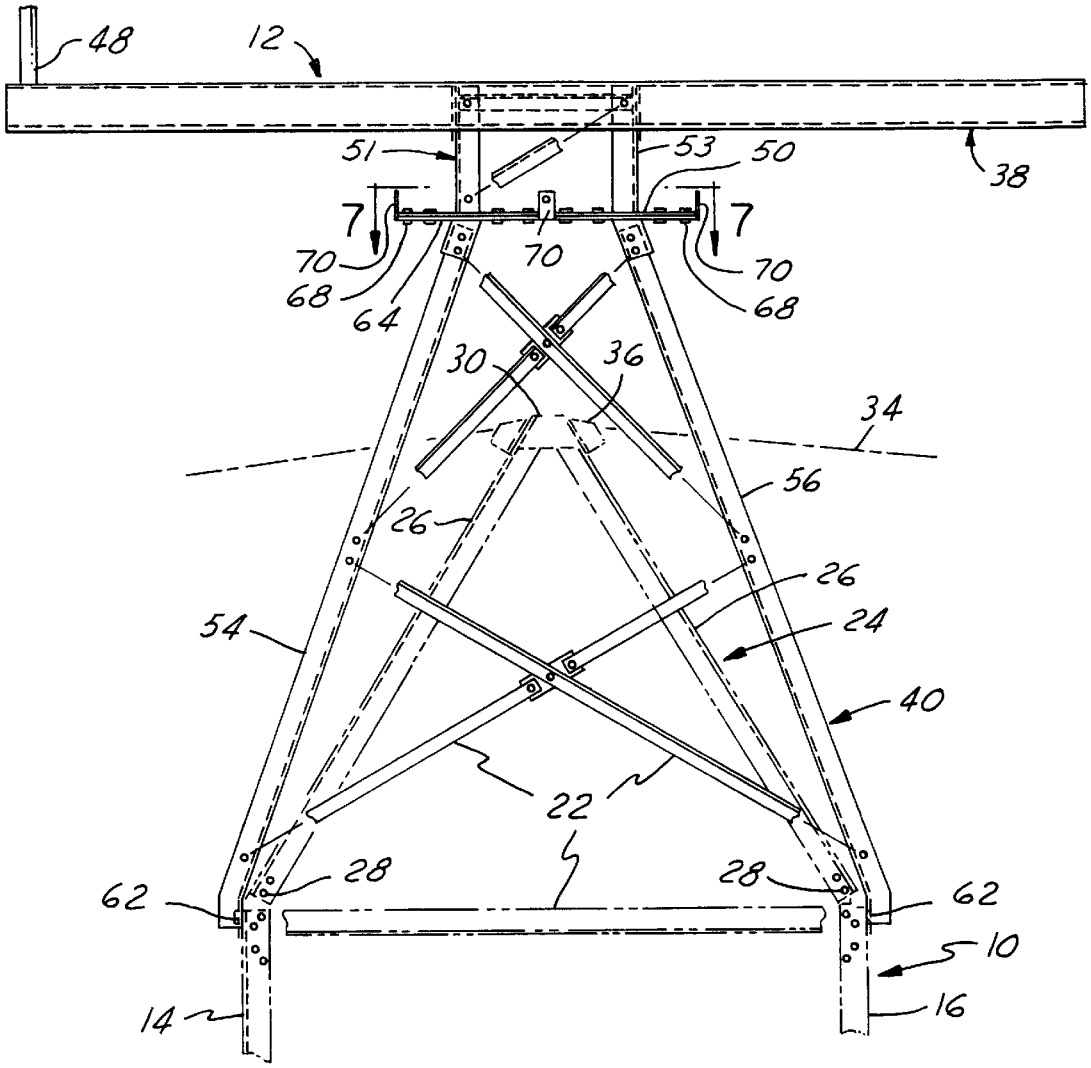
FIG. 3 is an enlarged fragmentary elevational view of an upper portion of the structure in FIG. 1, as seen from the side of the tower.
Figure 4:
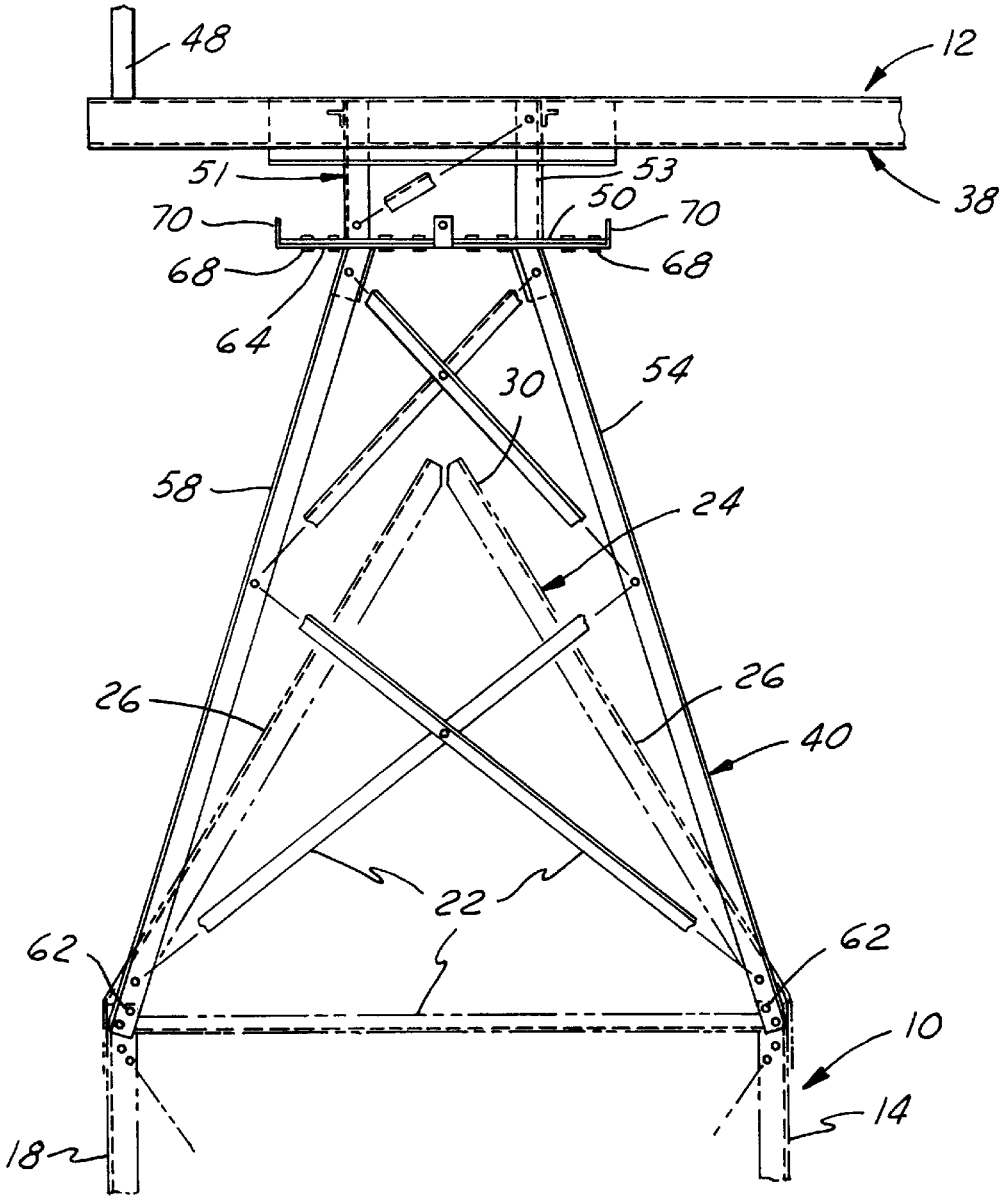
FIG. 4 is similar to FIG. 3 but taken from the front of the tower or 90° from the view in FIG. 3.
Figure 5:
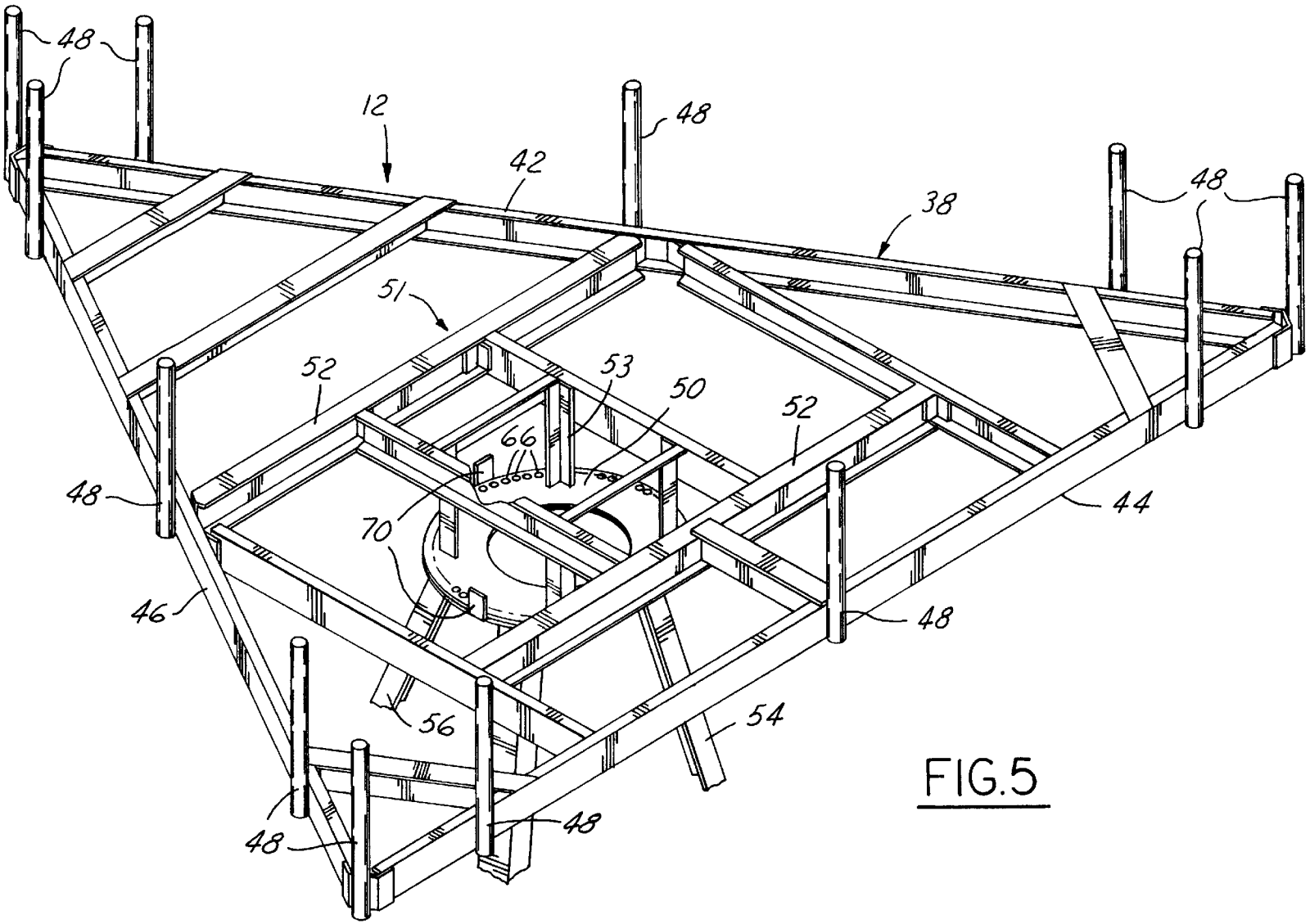
FIG. 5 is a fragmentary perspective view of the wireless telecommunication antenna mount.
Figure 6:
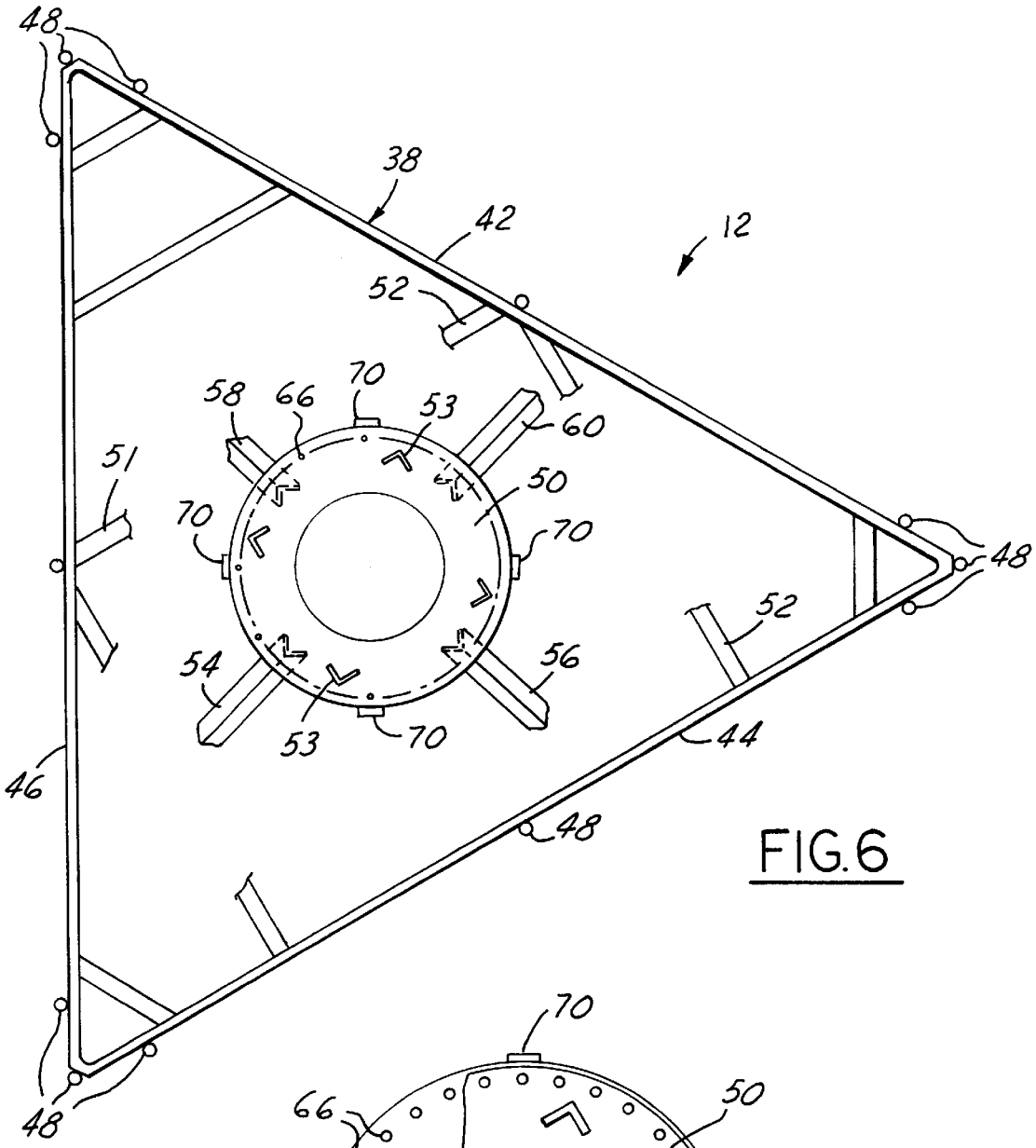
FIG. 6 is a top view of the wireless telecommunication antenna mount with parts broken away.
Figure 7:
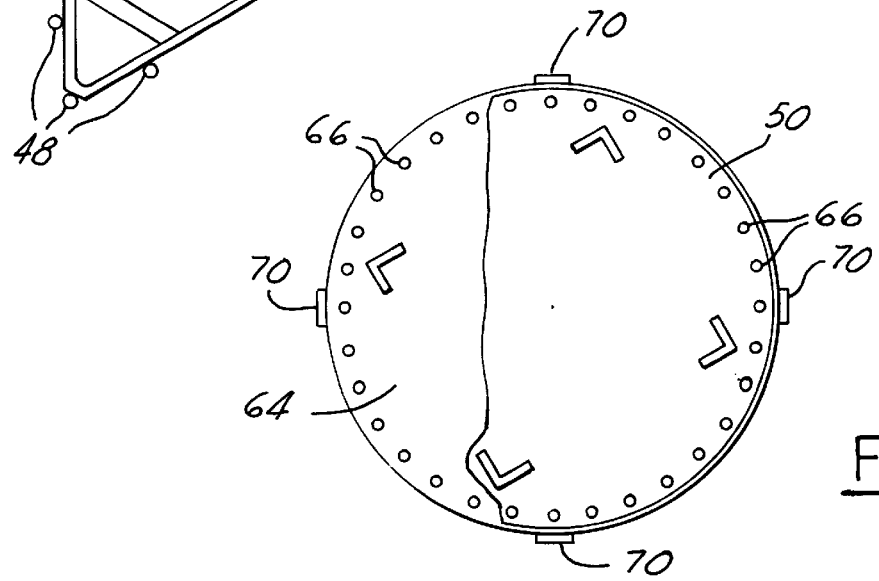
FIG. 7 is a sectional view taken on the line 7—7 in FIG. 3.
Figure 8:
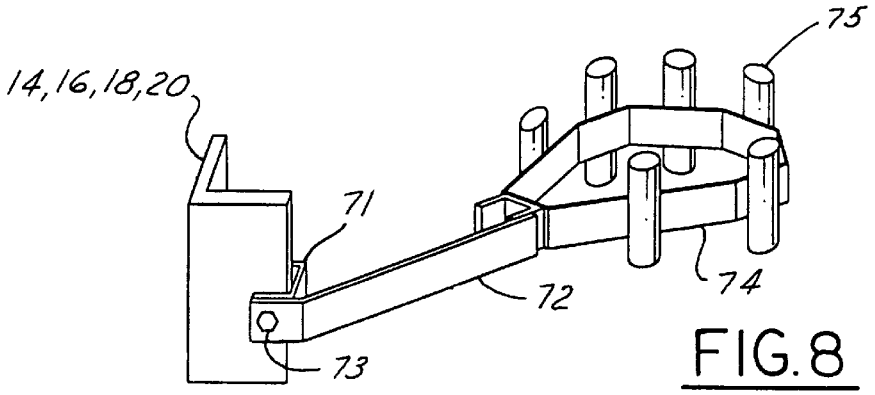
FIG. 8 is an isometric view of an antenna coax hanger bracket and tower leg.
Figure 9:
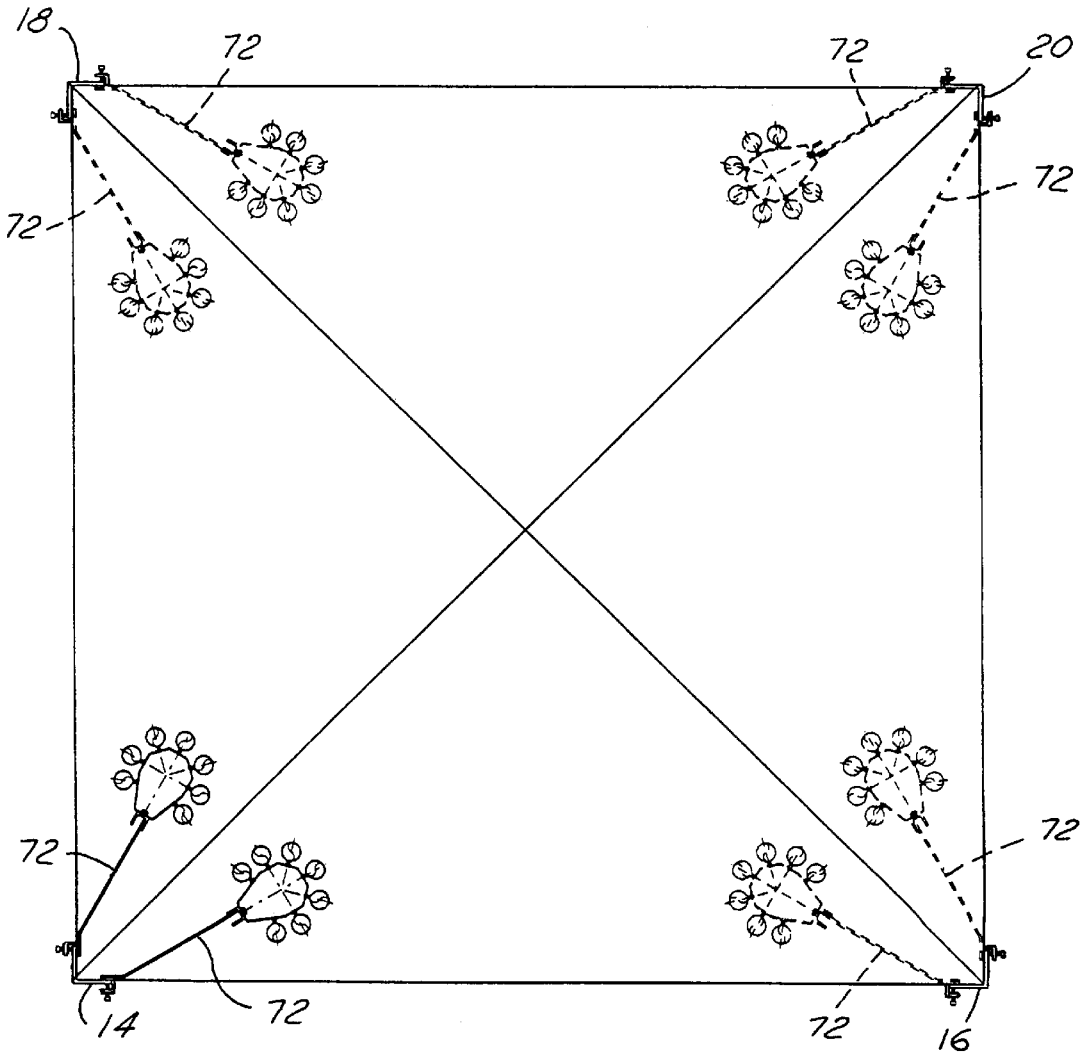
FIG. 9 is sectional view taken along line 9—9 of FIG. 1 and illustrating the electric power transmission tower body and the location of the hanger brackets on the tower legs.

Referring now more particularly to the drawings, an electric power transmission tower 10 is shown anchored in the ground and extending vertically upward from its anchorage. Above the top of the electric power transmission tower 10 is a wireless telecommunication antenna mount 12.

The electric power transmission tower 10 shown here is of the lattice type, consisting of four generally vertical legs 14, 16, 18 and 20 in a rectangular or square configuration, interconnected by a plurality of cross braces 22 for strength and reinforcement. The electric power transmission tower 10 is completed by a top portion or peak 24 formed by upwardly and inwardly inclined members 26 which have their lower ends secured to the upper ends of legs 14–20 by any suitable means as by fasteners 28 and their upper ends secured together where they meet at the peak 30. The electric power transmission tower 10 has horizontally extending arms 32 which support the electric power phase conductors or wires 33 that extend from one tower to the next along a row of towers. The conventional shield wires 34 on a bracket 36 are supported at the peak 30 of the tower and also extend from one tower to the next.

The wireless telecommunication antenna mount 12 comprises a platform 38 and a pedestal 40. The platform 38 is formed of three members 42, 44 and 46 connected end-to-end preferably in the form of an equilateral triangle. Antenna holders 48 are mounted at spaced intervals on the members 42, 44 and 46. Beneath the platform 3 8 is a circular plate 50 which is connected to the platform by a frame 51 consisting of members 52 and 53. The plate 50 is parallel to the plane of the platform and concentric therewith.

The pedestal 40 comprising of members 54, 56, 58 and 60 and cross braces 22 have their lower ends secured to the top of the tower legs 14, 16, 18 and 20 by any suitable means as by the fasteners 62. The members 54, 56, 58 and 60 are inclined upwardly and inwardly and at their upper ends mount a circular, horizontal plate 64.

The plates 50 and 64 are similar in size and each has a series of fastener holes 66. The plates are releasably secured together by any suitable means or by nut and bolt assemblies 68 each consisting of a bolt extending through one of the holes 66 and a nut threaded on the bolt. Around the periphery of the plate 64 are circumferentially spaced locators 70 which extend upwardly and serve to engage the periphery of the plate 50 to center plate 50 on plate 64. Each locator 70 contains a hole which allows the use of a safety bar to be inserted therein to prevent tipping of the antenna platform during the manual alignment or rotation process.

When mounted on the pedestal by the plates 50 and 64, the platform 38 is horizontal. The platform 38 may be rotatably adjusted by detaching the nut and bolt assemblies 68, then rotating plate 50 relative to plate 64 and finally reattaching the nut and bolt assemblies. The rotatable adjustment of the platform 38 is about a vertical axis extending through the center of the transmission tower. This rotatable function could be mechanically driven by a motor and gear reduction assembly or other suitable method.

The wireless telecommunication antenna mount may be quickly and easily attached to the top of an existing electric power transmission tower. No separate pole is required since the electric power transmission tower takes the place of a separate pole and provides the sole support for the antenna mount. The antenna mount 12 is supported a distance above the transmission tower 10 and does not interfere with the shield wire(s) 34. If the height of the antenna needs to be extended the members 54, 56, 58 and 60 can be increased in length. It is also possible to install this antenna mount without de-energizing the phase conductors 33 or detaching the shield wire(s) 34.

A special hanger bracket 72 is attached to tower legs 14, 16, 18 or 20 with clamp 71 and bolt 73. This bracket is thus installed without drilling tower legs 14–20, and is used to both support and train the antenna coax cables 75 from the antenna to ground based equipment.

What is claimed is:

1. In combination, an upright electric power transmission tower having arms adjacent an upper portion of the tower supporting electric power phase conductor wires and having at least one shield wire above the conductor wires, a wireless telecommunication antenna mount comprising a platform and a pedestal, at least one antenna holder mounted on said platform, means mounting said pedestal on said upper portion of said tower, said pedestal having an upwardly projecting portion above said at least one shield wire, and means securing said platform to the upwardly projecting portion of said pedestal at an elevation above and clear of said at least one shield wire, wherein said means securing said platform to the upwardly projecting portion of said pedestal comprises a first plate on said platform and a second plate on said pedestal, one of said plates being rotatable relative to the other, and means for releasably securing said plates together in selected angularly adjusted positions.

2. In combination, an upright electric power transmission tower having arms adjacent an upper portion of the tower supporting electric power phase conductor wires and having at least one shield wire above the conductor wires, a wireless telecommunication antenna mount comprising a platform and a pedestal, at least one antenna holder mounted on said platform, means mounting said pedestal on said upper portion of said tower, said pedestal having an upwardly projecting portion above said at least one shield wire, and means securing said platform to the upwardly protecting portion of said pedestal at an elevation above and clear of said at least one shield wire, wherein the upper portion of said electric power transmission tower comprises a plurality of angularly spaced, generally vertical logs, said pedestal comprises a plurality of upwardly extending, elongated members having lower ends secured to said respective legs, said elongated members extending in an upward direction and terminating in upper ends above said at least one shield wire, said means securing said platform to the upwardly projecting portion of said pedestal comprising a first horizontal circular plate secured to said platform, a second horizontal circular plate secured to the upper ends of the elongated members of said pedestal, one of said plates being rotatable relative to the other, and means releasably securing said plates together in selected angularly adjusted positions.

3. The combination as defined in claim 2, wherein said platform is in the form of a polygonal frame having sides on which the at least one antenna holder is mounted.

4. The combination as defined in claim 3, wherein the means for releasably securing said plates together comprises a plurality of nut and bolt assemblies.

5. The combination as defined in claim 4, further including locators on the periphery of one of said plates engagable with the other of said plates to center the plates relative to one another.

6. The combination as defined in claim 5, wherein angularly adjusting and releasably securing said plates together is accomplished by a remotely controlled mechanism.

7. The combination as defined in claim 6, further including a hanger bracket installed on at least one of said tower legs to support antenna coaxial cables, said hanger bracket comprising a generally U-shaped open-formed clamp adapted to receive a flange of one of said tower legs without enclosing said flange and a bolt threaded through said clamp into bearing engagement with said flange without piercing said flange.

* * * * *